US006509305B1

(12) United States Patent
Mitsumori et al.

(10) Patent No.: US 6,509,305 B1
(45) Date of Patent: Jan. 21, 2003

(54) METHOD FOR PREPARING CLEANING SOLUTION

(75) Inventors: Kenichi Mitsumori, Sendai (JP); Eui-Yeol Oh, Sendai (JP); Yasuhiko Kasama, Sendai (JP); Tadahiro Ohmi, 1-17-301, Komegafukuro 2-chome, Aoba-ku, Sendai-shi, Miyagi-ken, 980-0813 (JP); Takashi Imaoka, Toda (JP)

(73) Assignees: Tadahiro Ohmi, Tokyo (JP); Organo Corporation, Tokyo (JP)

( * ) Notice: Subject to any disclaimer, the term of this patent is extended or adjusted under 35 U.S.C. 154(b) by 0 days.

(21) Appl. No.: 09/570,575

(22) Filed: May 12, 2000

Related U.S. Application Data

(62) Division of application No. 09/103,573, filed on Jun. 24, 1998, now Pat. No. 6,086,057.

(30) Foreign Application Priority Data

Jun. 24, 1997 (JP) ..... 9-167780
Jun. 15, 1998 (JP) ..... 10-166695

(51) Int. Cl.[7] ..... C11D 11/00
(52) U.S. Cl. ..... 510/175; 510/108; 510/405
(58) Field of Search ..... 510/175, 108, 510/405

(56) References Cited

U.S. PATENT DOCUMENTS 4,836,929 A * 6/1989 Baumann et al. ..... 210/760
5,082,518 A * 1/1992 Molinaro ..... 261/122.1
5,261,966 A * 11/1993 Mashimo et al. ..... 134/2
5,404,732 A * 4/1995 Kim ..... 261/122.1
5,484,512 A * 1/1996 Sasaki et al. ..... 204/129
5,498,347 A * 3/1996 Richard ..... 210/760
5,514,284 A * 5/1996 Uban et al. ..... 210/760
5,565,107 A * 10/1996 Campen et al. ..... 210/760
5,645,727 A * 7/1997 Bhave et al. ..... 210/651
5,670,094 A * 9/1997 Sasaki et al. ..... 261/DIG. 42
5,720,905 A * 2/1998 Ho ..... 261/122.1
5,762,684 A * 6/1998 Hayashi et al. ..... 95/24
5,776,296 A * 7/1998 Matthews ..... 261/122.1
5,795,494 A * 8/1998 Hayami et al. ..... 216/83
5,800,626 A * 9/1998 Cohen et al. ..... 134/1.3
5,928,573 A * 7/1999 Spencer et al. ..... 261/122.1
6,017,827 A * 1/2000 Morgan et al. ..... 438/745

FOREIGN PATENT DOCUMENTS

JP 61-254219 * 11/1986 ..... 261/122.1
JP 403041729 A * 2/1991

* cited by examiner

*Primary Examiner*—Lorna M. Douyon
(74) *Attorney, Agent, or Firm*—Fish & Richardson P.C.

(57) ABSTRACT

Deionized water from a deionized water source (21) for electrolysis is supplied by a pressurizing pump (20) to an electrolyzer (2) to obtain a hydrogen gas and ozone gas by means of electrolysis. The pressures of these gasses are maintained at not less than the atmospheric pressure. These gasses at a pressure of the atmospheric pressure or more are dissolved in high-purity water in gas dissolving units (6,7) to obtain ozone water and hydrogen water respectively. These ozone water and hydrogen water are introduced into mixer (8,9) to adjust pH respectively. In this way, highly-concentrated, gas dissolved cleaning solution is prepared in a short period of time.

8 Claims, 12 Drawing Sheets

METHOD FOR PREPARING CLEANING SOLUTION

This application is a division of U.S. application Ser. No. 09/103,573, filed Jun. 24, 1998, U.S. Pat. No. 6,086,057.

BACKGROUND OF THE INVENTION

1. Field of the Invention

The present invention relates to a method and device for preparing cleaning solutions.

2 Description of Related Art

The present inventors have already found that hydrogen water wherein a hydrogen gas is dissolved in deionized water and ozone water in which an ozone gas is dissolved in deionized water are effective for cleaning electronic parts such, for example, as semiconductor substrates, substrates used for liquid crystal displays and the like.

Generally, when a hydrogen gas or ozone gas is dissolved in deionized water, such a gas is dissolved under atmospheric pressure.

It is however, time-consuming, for a gas to reach a desired concentration when the gas is dissolved under atmospheric pressure.

What is worse, hydrogen or ozone water of sufficiently high concentrations cannot be obtained under this condition.

SUMMARY OF THE INVENTION

It is an object of the present invention to provide a method and device that can prepare highly-concentrated gas dissolved cleaning solutions in a short period of time.

It is another object of the present invention to provide a method and device for preparing cleaning solutions that have effective detergency and are easy to recycle by controlling the amount of a dissolved gas, thereby reducing the consumption of deionized water while recycling the waste cleaning solution.

An aspect of the present invention to carry out the aforementioned objects is a method for preparing cleaning solutions for cleaning objects to be cleaned such as an electronic parts member, comprising a step of dissolving any of an oxidative gas, reductive gas, inert gas, a mixture of an oxidative gas and an inert gas, or a mixture of a reductive gas and an inactive gas in deionized water while controlling the supply pressure of such a gas at a value exceeding the atmospheric pressure.

Electronic parts here can be exemplified by semiconductor substrates, substrates used for liquid crystal displays, magnetic substrates, and the like.

Examples of the oxidative gases include an ozone gas and oxygen gas. Examples of the reductive gases include a hydrogen gas or the like. Examples of inert gases include a helium gas, argon gas, krypton gas, xenon gas, neon gas, nitrogen gas and the like.

Deionized water is generally water (primary deionized water) produced by treating raw water in a primary deionized water production device comprising a coagulating sedimentation unit, sand filtration unit, active carbon filtration unit, reverse osmosis unit, two-bed ion exchange system, mixed-bed type ion exchange system, micronic filter unit and so forth.

In addition, generally high-purity water can be obtained by treating the above deionized water stored in a deionized water reservoir in a secondary deionized water production system comprising ultraviolet irradiation apparatus, mixed-bed type polisher and membrane separation unit such as ultrafiltration unit and reverse osmosis unit arranged in that order to remove residual impurities in the primary deionized water such as fine particles, colloidal materials, organic metals, and anions as much as possible, yielding high-purity water (secondary deionized water) suitable for wet treatment of objects to be rinsed. In a commonly used configuration, high-purity water (secondary deionized water) thus obtained is generally supplied to the points of use and any excessive high-purity water is returned (secondary deionized water) to the above-mentioned primary deionized water reservoir via a return line.

Water quality of high-purity water (secondary deionized water) is shown in table 1:

High-purity water (secondary deionized water) and the above-mentioned primary deionized water are collectively referred to as deionized water herein.

TABLE 1

| | |
|---|---|
| Resistivity | ≦18.0 MΩ · cm |
| Total organic carbon | ≦10 μg C/l |
| Number of fine particles | ≦10/ml (diam. ≦0.07 μm) |
| CFU | ≦10/l |
| Dissolved oxygen | ≦10 μg O/l |
| Silica | ≦1 μg $SiO_2$/l |
| Sodium | ≦0.01 μg Na/l |
| Iron | ≦0.01 μg Fe/l |
| Copper | ≦0.01 μg Cu/l |
| Chloride ions | ≦0.01 μg Cl/l |
| Hydrogen ion concentration (pH) | 7 |
| Oxidation-reduction potential | 450 mV (vs. NHE) |

If a high-pressure cylinder gas is to be used as a gas supply source, the pressure of the gas supplied to deionized water may be controlled by a reducing valve.

If an oxidative gas (ozone gas) or reductive gas (hydrogen gas) is derived from a water electrolyzer, the pressure of such a gas supplied to deionized water may be controlled by controlling the pressure of water supplied to such electrolyzer: the pressure of the ozone gas or the hydrogen gas generated by way of the water electrolyzer is a function of the pressure of water supplied to such electrolyzer. Thus, the pressure of the ozone gas or the hydrogen gas generated can be adjusted to a desired value commensurate with a predetermined value of water supplied to the water electrolyzer. This may be accomplished by establishing the specific interrelationship between the pressure of a generated gas and that of supply water by preliminary experiment for each water electrolyzer.

The absolute pressure of a gas supplied to deionized water should preferably be not less than 1.0 kgf/cm$^2$ (=9.8×10$^4$ Pa, hereinafter kgf/ cm$^2$ is used for a pressure unit). When a gas is dissolved at such a pressure, a cleaning solution with particularly excellent detergency can be obtained. A pressure more than 5 kgf/cm2 is often meaningless, because a cleaning solution is usually used under the atmospheric pressure. Therefore, the preferable gas supply pressure is from 1 to 5 kgf/cm$^2$.

The pressure of deionized water should preferably be not less than 1 kgf/cm$^2$, and more preferably should range from 1 to 5 kgf/cm$^2$.

In the preparation of the cleaning solution, degassing deionized water is preferably carried out before dissolving an oxidative gas, reductive gas, or inert gas or a mixture gas of an oxidative gas and an inert gas or a mixture of a reductive gas and an invert gas because the detergency of a cleaning solution (deionized water that have dissolved an oxidative gas, reductive gas, or inactive gas or a mixture of an oxidative gas and an inert gas or a mixture of a reductive gas and an inactive gas) thus prepared is more effective than that of cleaning solution not so prepared. Said degassing of deionized water is usually carried out using a vacuum degassing unit or a membrane-degassing unit.

It is preferable to dissolve a gas in deionized water by diffusing the gas in it through a gas permeable membrane unit.

It is another feature of the cleaning solution manufacturing device according to the present invention that the device comprises a deionized water supply source, a supply source of an oxidative gas, reductive gas, or an inert gas or a mixture gas of an oxidative gas and an inert gas or a mixture gas of a reductive gas and an inert gas, a gas-dissolving unit wherein a gas from said supply source is dissolved in deionized water from said deionized water supply source to supply gas-dissolved cleaning solution to objects to be cleaned, and a gas supply pressure controller wherein the pressure of a supplied gas is controlled at a value exceeding the atmospheric pressure when dissolving the gas in deionized water.

A cylinder gas itself, for example, may be used as a supply source of an oxidative gas, reductive gas, or inert gas, or a mixture gas of an oxidative or reductive gas and an inert gas. If an oxidative gas is an ozone gas and if a reductive gas is a hydrogen gas, a water electrolyzer may be used as the gas supply source.

It is preferable that the cleaning solution manufacturing device further comprises a degassing unit wherein deionized water from said deionized water supply source is degassed to supply deionized water degassed in the degassing unit to the gas-dissolving unit. The detergency of cleaning solution thus prepared can be enhanced by removing a nitrogen gas in the air normally dissolved in deionized water.

With reference to a gas supply pressure controller wherein the pressure of a supplied gas is controlled at a value exceeding the atmospheric pressure when dissolving the gas in deionized water, if a high-pressure cylinder gas is used as a gas supply source as mentioned above, a pressure reducing valve may be used. When a water electrolyzer is used as the gas supply source, a pressure controller (for example, a pressure Pump) may be used to control the pressure of deionized water supplied to the water electrolyzer.

The gas-dissolving unit is preferably a gas permeable membrane unit wherein a gas is diffused in deionized water through the membrane.

Since the concentration of a gas dissolved in deionized water is proportional to the supply pressure of the gas, the gas supply pressure can be controlled by detecting the gas concentration in deionized water. Based on this fact, the concentration of a gas dissolved in deionized water can be controlled to a desired level by installing a gas concentration detector unit wherein the concentration of the gas dissolved in deionized water is detected, and a control system wherein a gas supply pressure controller operates based on the signal from the gas concentration detector unit.

DETAILED DESCRIPTION OF THE PREFERRED EMBODIMENTS (First Embodiment)

Figure 1:
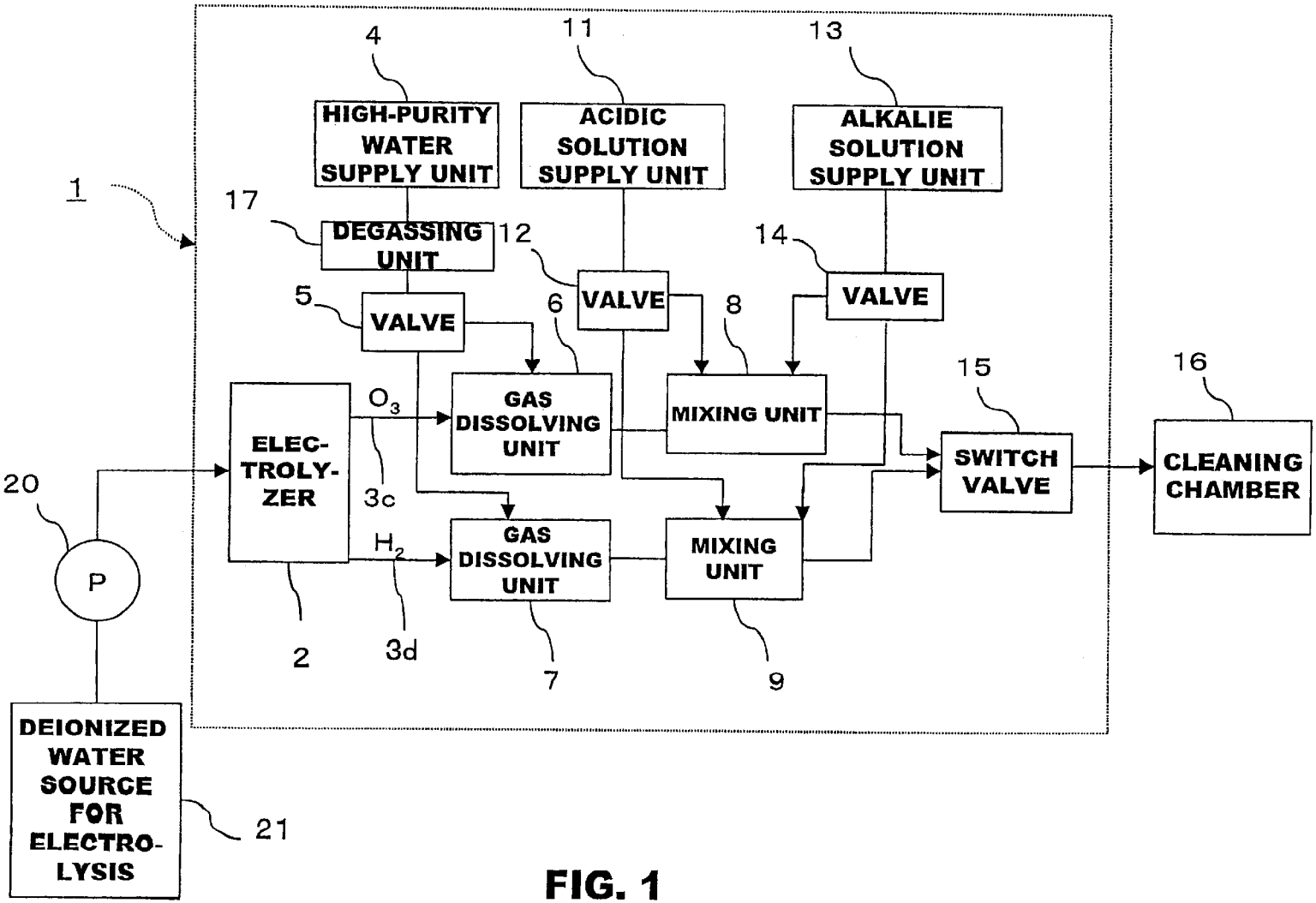
FIG. 1 is a conceptual diagram of a cleaning solution-preparing device according to a first embodiment of the present invention.

FIGS. 1 illustrates a cleaning solution preparation device according to a first embodiment of the present invention, which comprises a cleaning apparatus including a cleaning solution preparation part and a cleaning chamber. There is shown in FIG. 2 a water electrolyzer incorporated in the first embodiment of the invention as shown in FIG. 1 wherein ozone gas and hydrogen gas are generated.

The cleaning solution preparation part 1 includes the electrolyzer 2 wherein ozone gas and hydrogen gases are generated from deionized water.

Figure 2:
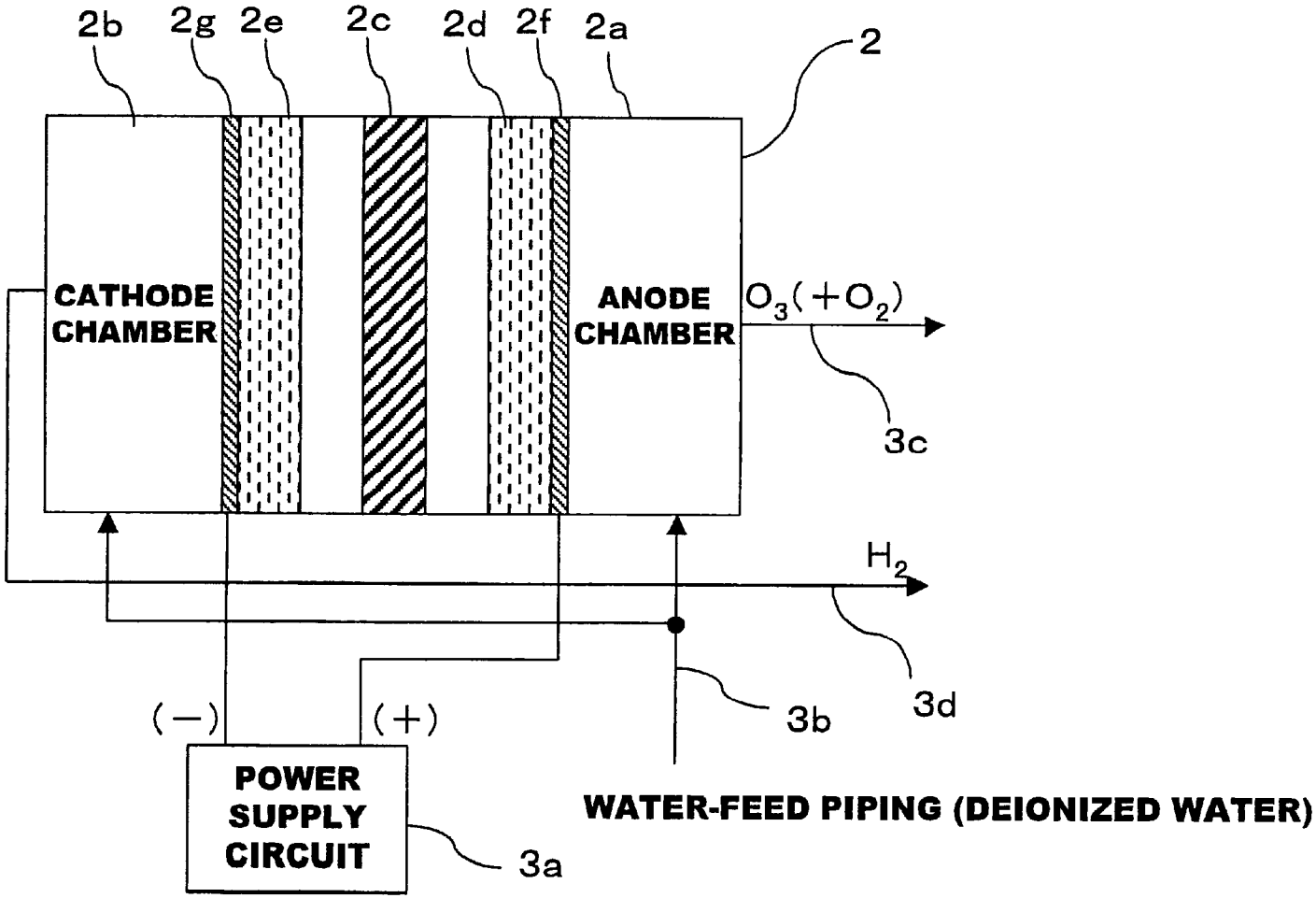
FIG. 2 is a conceptual internal drawing of the water electrolyzer in FIG. 1.

As shown in FIG. 2, the electrolyzer 2 comprises an anode chamber 2*a*, cathode chamber 2*b*, ion exchange membrane 2*c* provided at a center portion thereof, anode-side catalyst 2*d*, and cathode-side catalyst 2*e*. Deionized water for electrolysis is supplied to each chamber through water-feed piping 3*b*. A power supply circuit 3*a* supplies DC current to electrodes on anode side and cathode side. Ozone gas ($O_3$) with slight amount of an oxygen gas ($O_2$) generated in the anode chamber 2*a* is discharged through a supply piping 3*c*, while hydrogen gas ($H_2$) generated in the cathode chamber 2b is discharged through a supply piping 3*d*.

A high-purity water supply unit 4 supplies high-purity water produced, as mentioned earlier, from primary deionized water by removing as much fine particles, colloidal microorganisms, organic matter, metals, ions, and dissolved oxygen as possible by way of ultraviolet irradiation apparatus, mixed-bed type polisher, ultrafiltration unit and the like. High-purity water supplied from the high-purity water supply unit 4 is switched by a valve 5 to be selectively supplied to gas-dissolving units 6 or 7. In the gas-dissolving unit 6, ozone gas is supplied from the supply piping 3*c* to gas permeable hollow fiber membrane from its outside while high-purity water flows inside the gas permeable hollow fiber membrane at a predetermined flow rate, and the ozone gas is mixed with high-purity water while flowing through the gas permeable hollow fiber membrane, thus ozone water being produced. In a similar manner, in the gas-dissolving unit 7, hydrogen gas is supplied from the supply piping 3*d* to gas permeable hollow fiber membrane from its outside while high-purity water flows inside the gas permeable hollow fiber membrane at a predetermined flow rate, and the hydrogen gas is mixed with high-purity water while flowing through the gas permeable hollow fiber membrane, thus producing hydrogen water.

When the gas is to be dissolved in high purity water, the gas may flow inside the hollow fiber membrane, and the deionized water may flow outside the hollow fiber. Furthermore, instead of the gas permeable membrane, a mechanical gas-dissolving unit which draw a gas by means of ejector to dissolve the drawn gas may be used. Moreover, a gas may be dissolved by way of aeration using an air diffuser or mechanical agitation performed in a pressurized vessel.

A mixing unit 8 is arranged following the gas-dissolving unit 6, and a mixing unit 9 is arranged following the gas-dissolving unit 7. Acidic reagent solution supplied from an acid solution supply unit 11 is switched by a valve 12 to be selectively supplied to the mixing unit 8 or 9. Alkali reagent solution supplied from an alkali solution supply unit 13 is switched by a valve 14 to be selectively supplied to the mixing unit 8 or 9. As mixing unit 8 or 9, a line mixer is usually used.

Acidic reagent solution supplied from the acid solution supply unit 11 includes, for example, HCl (hydrochloric acid), HF (hydrogen fluoride) $HNO_3$ (nitric acid), $H_2SO_4$ (sulfuric acid), or the like.

Alkali reagent solution supplied from the alkali solution supply unit 13 includes, for example, $NH_4OH$ (ammonium hydroxide), KOH (potassium hydroxide), NaOH (sodium hydroxide), or the like.

When acidic reagent solution containing HCl, HF, $HNO_3$, $H_2SO_4$, or the like is mixed with ozone water in the mixing unit 8, oxidative, acidic cleaning solution is produced. When alkali reagent solution containing $NH_4OH$, KOH, NaOH, or the like is mixed with ozone water in the same mixing unit 8, oxidative, alkali cleaning solution is produced.

When alkali reagent solution containing $NH_4OH$, KOH, NaOH, or the like is mixed with hydrogen water in the mixing unit 9, reductive, alkali cleaning solution is produced. When acidic reagent solution such as HCl, HF, $HNO_3$, $H_2SO_4$ or the like is mixed with hydrogen water in the mixing unit 9, reductive, acidic cleaning solution is produced.

Acidic or alkali, oxidative cleaning solution supplied from the mixing unit 8 and acidic or alkali, reductive cleaning solution supplied from the mixing unit 9 are switched by a valve 15 to be selectively supplied to a cleaning chamber 16. As a result, objects to be cleaned such as substrate used for liquid crystals or the like are washed by any of the four kinds of cleaning solution in the cleaning chamber 16. That is, in the cleaning solution preparation part 1, any of the four kinds of cleaning solution is selectively produced to be supplied to the cleaning chamber 16 wherein objects to be cleaned such as semiconductor devices are washed. The manufacturing of semiconductors comprises a plurality of processes and different kinds of cleaning solution are often required depending on the processes. Thus, it is preferable to produce plural kinds of cleaning solution one after another in the cleaning solution preparation part 1. Furthermore, since oxidative and reductive gas-dissolved cleaning solution can be produced simultaneously in the gas-dissolving units 6 and 7, it is also preferable to store either of the cleaning solutions. Moreover, it is preferable to install four mixing units to produce four kinds of wash water at any time, and to store them respectively and then supply them to the cleaning chamber 16, as appropriate. Furthermore, in the manufacturing of semiconductors, plural processes may take place in the separate locations. In this situation, plural kinds of cleaning solution may be supplied to locations requiring these solutions or one kind of cleaning solution may be supplied to plural locations.

Moreover, in the cleaning solution preparation part 1, oxidation-reduction potential or pH of cleaning solution can be set optionally by controlling the concentration of acid or alkali solution dissolved in ozone water or hydrogen water. Therefore, the degree of detergency can be adjusted depending on the kinds of adhering contaminants in each manufacturing process of, for example, substrates used for liquid crystals.

The feature of the cleaning solution-preparation device shown in FIG. 1 is that this device includes a pressure pump 20 to pressurize deionized water supplied to the electrolyzer 2. It is the pressure pump 20 that constitutes the gas supply pressure controller according to the present invention. Specifically, if the pressure of the pressure pump 20 is controlled, the pressures of an ozone gas and hydrogen gas to be generated in the electrolyzer 2 can be controlled. Since the ozone gas and hydrogen gas to be generated in the electrolyzer 2 are supplied to the respective gas-dissolving units 6 and 7, the pressures of these gasses correspond to the supply pressures. The optimal level of the pressure of deionized water supplied to the electrolyzer 2 to make the pressure of an ozono gas and hydrogen gas higher than the atmospheric pressure may be sought by preliminary experiment using an actual electrolyzer. If the pressure of deionized water supplied to the electrolyzer 2 is generally controlled at that not lower than atmospheric pressure, and more preferably in the range from 1 $kg/cm^2$ to 5 $kg/cm^2$, and if the pressure of the inside of the electrolyzer 2 is controlled at the same pressure as that of deionized water supplied, the pressures of the ozone gas and hydrogen gas generated in the water electrolyzer 2 can be made higher than the atmospheric pressure. That is, because the inside of the electrolyzer 2 is hermetically sealed, the ozone gas and hydrogen gas generated herein are pressurized corresponding to the inside pressure. Since these gasses are introduced into the gas-dissolving units 6 and 7 respectively as they are, the ozone gas and hydrogen gas thus pressurized are dissolved in high-purity water here. Alternatively, gasses obtained in the electrolyzer 2 may be pressurized at pressure not lower than the atmospheric pressure by a booster pump, instead of pressurizing these gases the inside of the electrolyzer 2.

Figure 3:
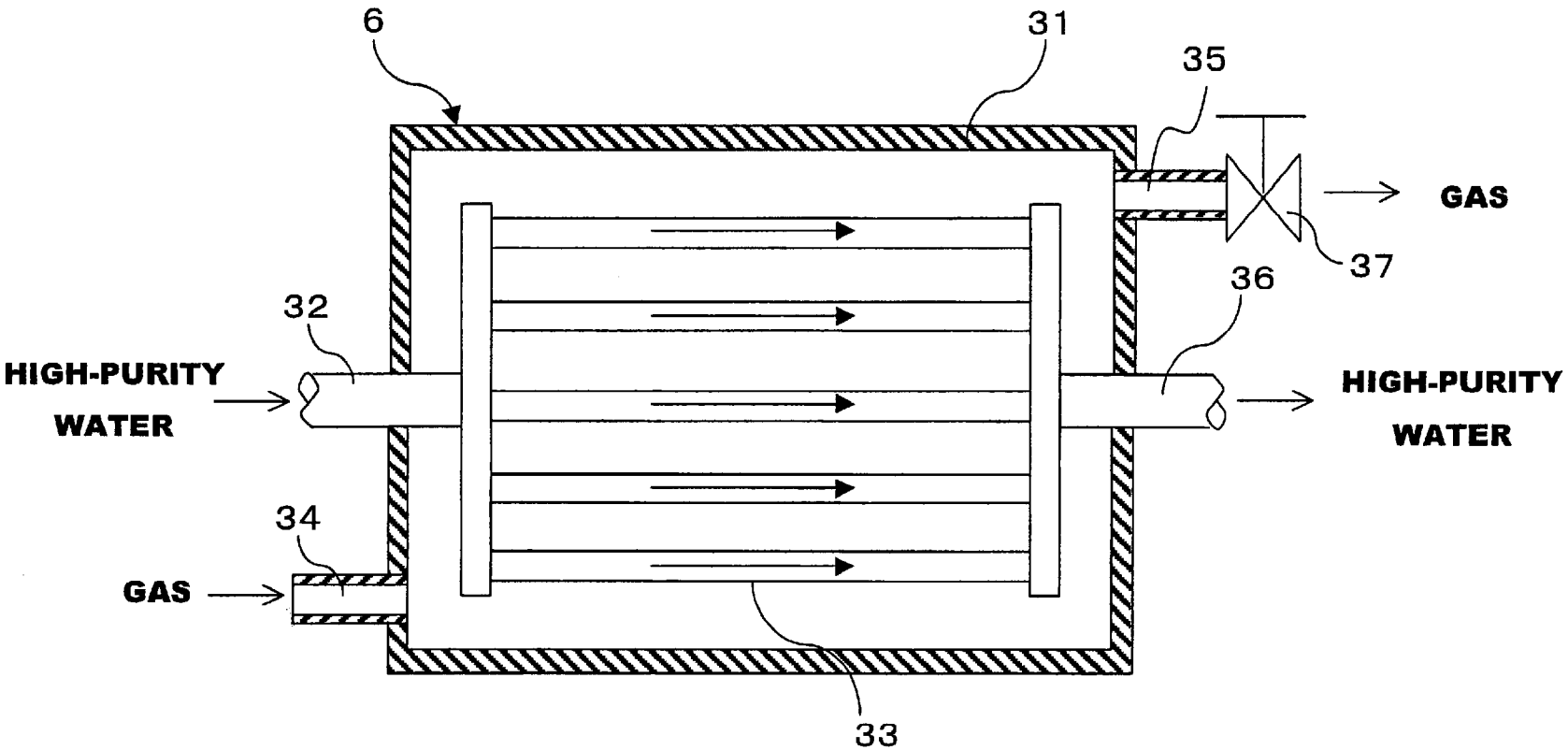
FIG. 3 is a cross-sectional view of a mixing unit in FIG. 1.

Referring now to the drawing FIG. 3, this figure shows the inside of the gas-dissolving units 6 (or 7) according to an embodiment of the invention configured to mix deionized water and gas to dissolve the gas in the deionized water and to supply this gas-dissolved water to objects to be cleaned.

Referring to FIG.3, the gas-dissolving unit 6 comprises a container 31, a hollow fiber membrane module 33 composed of gas permeable membrane which is disposed inside the container 31, a high-purity water supply port 32 for introducing high-purity water into the hollow fiber module 33, and a high-purity water (gas-dissolved water) exit 36 for discharging high-purity water from the hollow fiber module 33 to outside. High-purity water is introduced from a high-purity water supply unit via the high-purity water supply port 32, and the high-purity water (gas-dissolved water) exit 36 is connected with the mixing unit 8 or 9. If the pH thereof is not to be adjusted, the high-purity water (gas-dissolved water) exit 36 is connected with the points of use of cleaning solution (gas-dissolved water).

On the other hand, the container 31 includes a gas supply port 34 for introducing gas into the inside of the container 31 and a gas exit 35 for venting gas. Pressurized gas is introduced from a gas supply source (namely, in this embodiment of the invention, the electrolyzer 2) via the gas supply port 34. The gas exit 35 is connected with an exhaust system via a valve 37 which regulates the pressure of the inside of the container 31 at a predetermined value.

The valve 37 may be an on/off valve, a reducing valve or any other suitable type, as long as it can maintain the gas in a pressurized state. Furthermore, it is preferable to control the pressure of the inside of the gas-dissolving unit 6 or 7 to a predetermined value by controlling the valve 37 based on the reading of a pressure gauge installed to measure the pressure of the inside of the gas-dissolving unit 6 or 7.

Although gas and high-purity water are separated by the hollow fiber module 33, gas can be dissolved in high-purity water in the module 33, because only gas can permeate the module 33. Therefore, high-purity water discharged from the high-purity water or high-purity water exit 36 is gas-dissolved high-purity water.

Such gas-dissolving unit 6 may be, for example, Liqui-Cel (trade name) available from Separation Product Japan Co.

FIG. 3 shows a configuration wherein the flow direction of high-purity water in the hollow fiber module and the flow direction of gas outside the hollow fiber module are the same, or concurrent. However, another configuration is also preferable wherein the flow direction of high-purity water in the hollow fiber module and the flow direction of gas outside the hollow fiber module are different, or countercurrent. Further, passing gas inside the hollow fiber module, and passing high-purity water outside the module are also preferable. In this way, it is easy to raise gas pressure. Particularly, hydrogen gas is suitable for flowing inside the hollow fiber module to be dissolved in high-purity water. Conversely, ozone gas is suitable for flowing outside the hollow fiber module to be dissolved in high-purity water. Since the ozone gas is a strong oxidizer, materials to be exposed to the ozone gas must be ozone resistant. However, it is difficult to construct parts connecting hollow fiber with piping inside the hollow fiber module with ozone-gas resistant materials. In contrast, the inside of the container 31 and the outside of the hollow fiber module 33 are relatively easy to construct in the ozone gas-resistant manner.

The cleaning solution preparation device according to the first embodiment of the invention further comprises a degassing unit 17 disposed between the high-purity water supply unit 4 and a valve 5. The degassing unit 17 removes gasses dissolved in high-purity water supplied from the high-purity water supply unit 4. As the degassing unit 17, for example, a vacuum degassing unit may be used wherein water to be degassed runs downward through a vacuum packed tower. A membrane degassing unit may also be used wherein dissolved gasses are diffused and removed through a gas permeable membrane unit. Nitrogen gas in the air is dissolved in high-purity water supplied from the high-purity water supply unit 4. The detergency of oxidative and reductive cleaning solutions can be enhanced by removing this nitrogen gas. Also, oxygen gas in the air is dissolved in high-purity water supplied from the high-purity water supply unit 4. The detergency of reductive cleaning solution can be enhanced by removing this oxygen gas.

(Second Embodiment)

Next, the second embodiment of the present invention will be described by referring to FIG. 4.

Figure 4:
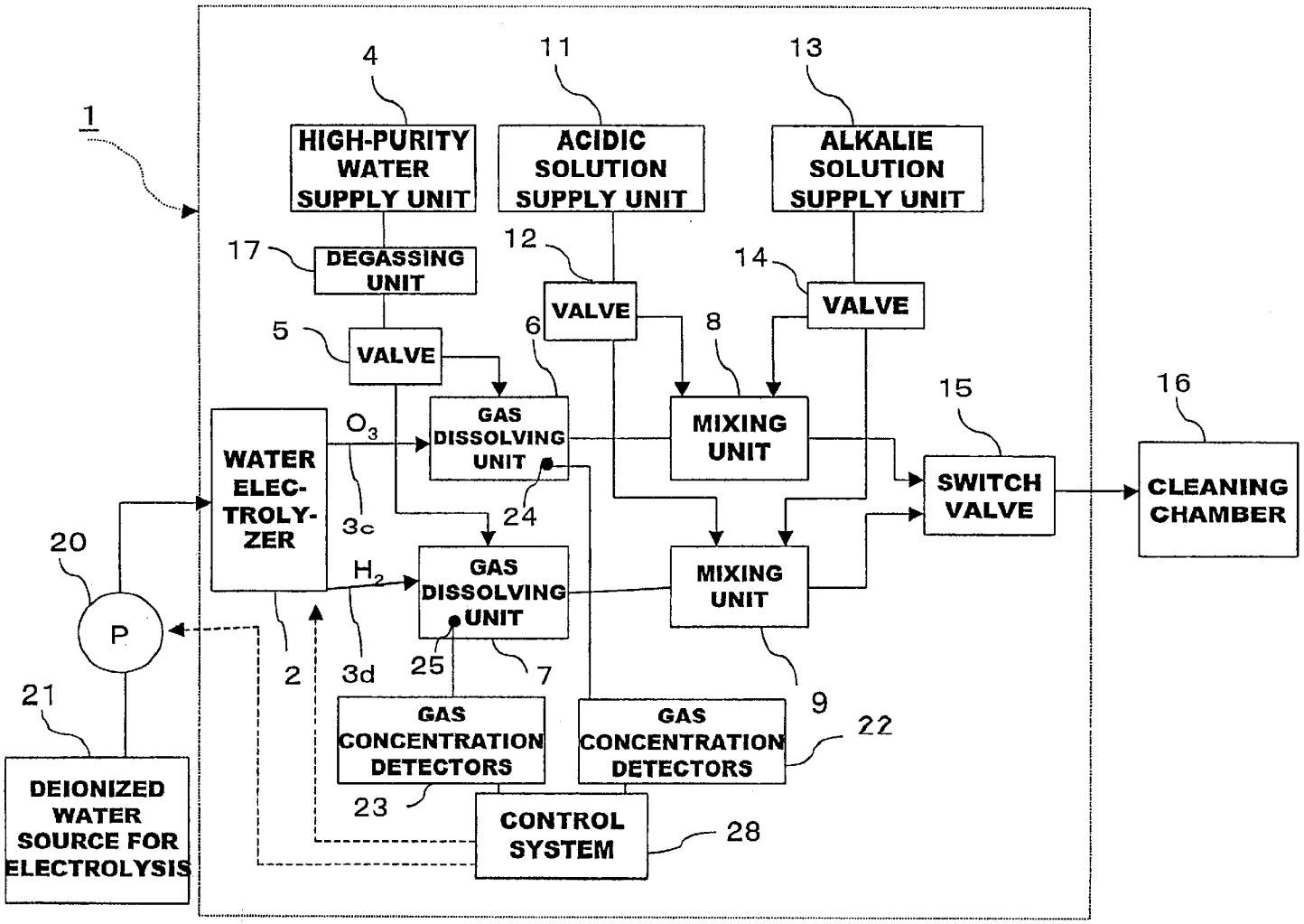
FIG. 4 is a conceptual diagram of the cleaning solution—manufacturing device according to another embodiment of the invention.

The cleaning solution preparation device according to the second embodiment of the present invention as shown in FIG. 4 comprises gas concentration detector units for detecting gas concentrations dissolved in the dissolving water of the gas-dissolving units 6 and 7, and a control system for operating the gas supply pressure controller (the pressure pump 20) based on signals from the gas concentration detector units, in addition to the configuration of the first embodiment of the invention. Further, the control system controls gas-generating speed based on signals from the gas concentration detector units and a valve 5.

The gas concentration detector units include gas sensors 24 and 25 provided in the gas-dissolving units 6 and 7 respectively, and gas concentration detectors 22 and 23. The gas sensors 24 and 25 may be placed, for example in the piping connecting the switch valve 15 and the cleaning chamber 16 other than the inside of the gas-dissolving unit 6, 7.

There is also arranged a control system 28 that controls the operation of the pressure pump 20, and therefore the pressure of deionized water supplied to the electrolyzer 2, based on signals from the gas concentration detector 22 or 23. Alternatively, the control system 28 controls the water electrolyzer 2 or its gas generating speed, based on signals from the gas concentration detector 22 or 23. Namely, when electrolytic current is controlled in the water electrolyzer 2, gas generating speed (quantity) can be controlled.

The configuration of the second embodiment enables stabilization of the concentration of gasses in cleaning solution in a constant manner, and consequently enables effectiveness of detergency with little variability.

The first and second embodiments employ the pressure pump 20 to control the pressure of gasses in the gas-dissolving units 6 and 7. Therefore, no extra gas booster is required. The absolute pressure of a gas supplied to the gas-dissolving units 6 and 7 is preferably not less than 1.0 $kgf/cm^2$. Cleaning solution containing too much oxidative or reductive gas is often meaningless, because the cleaning places at which cleaning solution is used are usually at atmospheric pressure. Moreover, higher pressure results in need for higher-pressure resistance of various devices, and therefore is economically disadvantageous. Accordingly, the pressure of the gas is preferably in the range from 1 to 5 $kgf/cm^2$, and more preferably from 1 to 2 $kgf/cm^2$.

(Third Embodiment)

The third embodiment of the present invention will next be described by referring to FIG. 5 of the accompanying drawings.

Figure 5:
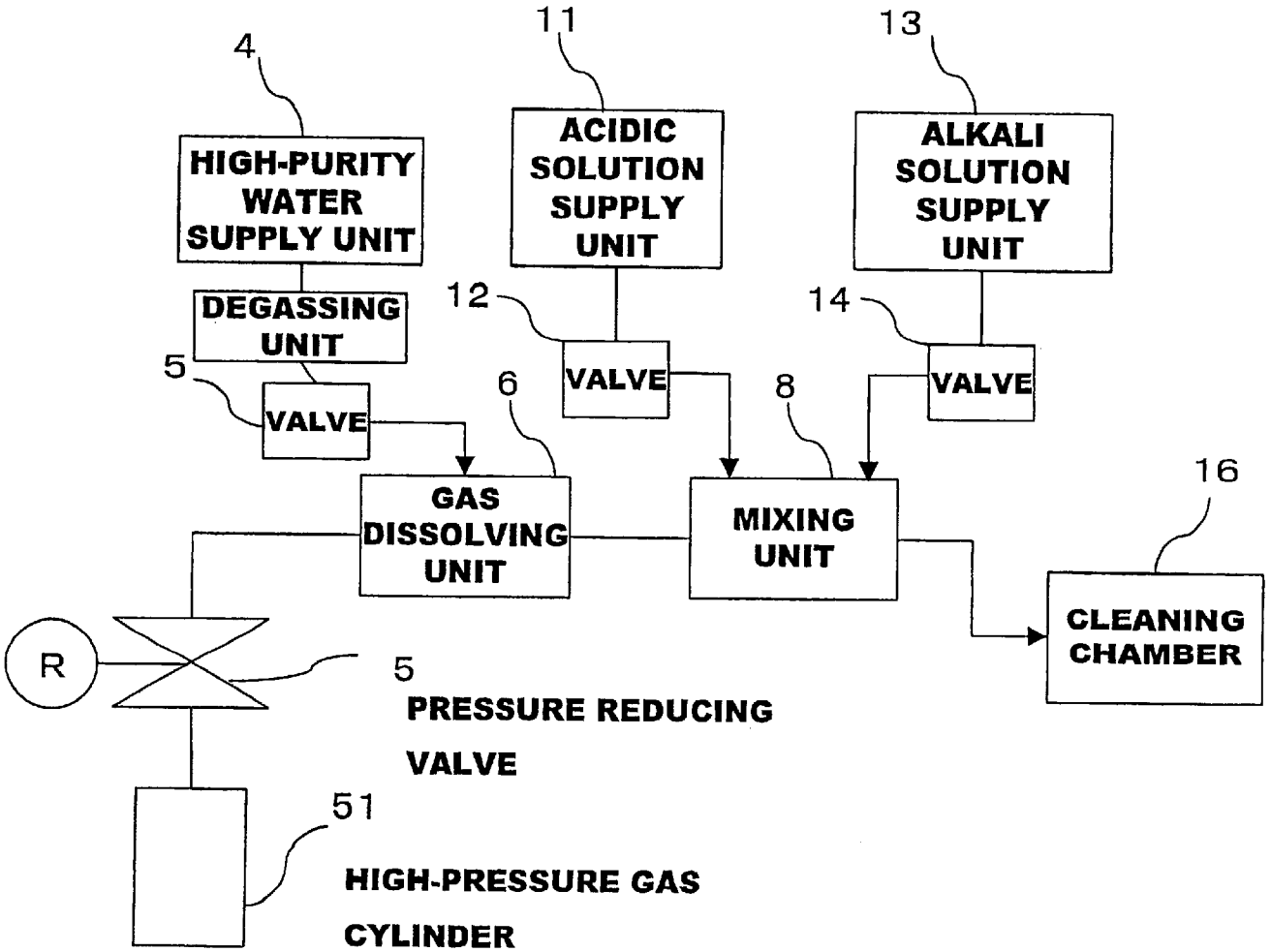
FIG. 5 is a conceptual diagram of the cleaning solution—manufacturing device according to yet another embodiment of the invention.

The cleaning solution preparation device according to the third embodiment of the invention shown in FIG. 5 employs a high-pressure gas cylinder as a gas supply source. A high-pressure gas cylinder 51 is connected with a gas-dissolving unit 6 via a pressure reducing valve 50. The high-pressure gas cylinder 51 is filled with reductive gas, inert gas, or oxidative gas at a high pressure. A high-pressure gas supplied from the high-pressure gas cylinder 51 is decompressed by the pressure-reducing valve 50 to be introduced into the gas-dissolving unit 6. Therefore, the third embodiment of the invention employs the pressure-reducing valve 50 as the gas supply pressure controller. The pressure-reducing valve 50 does not decompress to a pressure less than the atmospheric pressure.

The third embodiment of the invention is similar to the configuration of the first embodiment except that there is arranged only one gas line since only one gas is used in the case of the high-pressure gas cylinder as opposed to the water electrolyzer.

The third embodiment of the present invention may also include a gas concentration detecting unit and a gas supply pressure controller, as with the second embodiment of the invention. Also, a high-pressure gas cylinder of reductive gas may be connected with that of inert gas to mix and supply both gasses. Likewise, oxidative gas may be mixed with inert gas. However, piping systems must be clearly separated so as not to mix oxidative gas with reductive gas.

Particularly when a reductive cleaning solution is desired, this configuration is highly preferable, since a hydrogen gas cylinder can easily be obtained. On the contrary, when a great deal of ozone water is required, an ozonator using silent discharge, etc. may be employed.

EXAMPLE 1

In this example, the effect of the pressure of high-purity water in the gas-dissolving unit on the amount of dissolved gas in high-purity water was investigated for each gas supply pressure using the cleaning solution preparation device shown in FIG. 5.

The test conditions were as follows:

Flow rate of high-purity water supplied to the gas-dissolving unit:

2 $m^3$/hr

Pressure of high-purity water in the gas-dissolving unit:

1 kgf/$cm^2$ 2 kgf/$cm^2$ 3 kgf/$cm^2$ 4 kgf/$cm^2$

Hydrogen gas supply pressure:

0.5 kgf/$cm^2$ 1 kgf/$cm^2$ 1.5 kgf/$cm^2$ 2 kgf/$cm^2$

Gas-dissolving unit: 4" module available from Hoechst Co.

Figure 6:
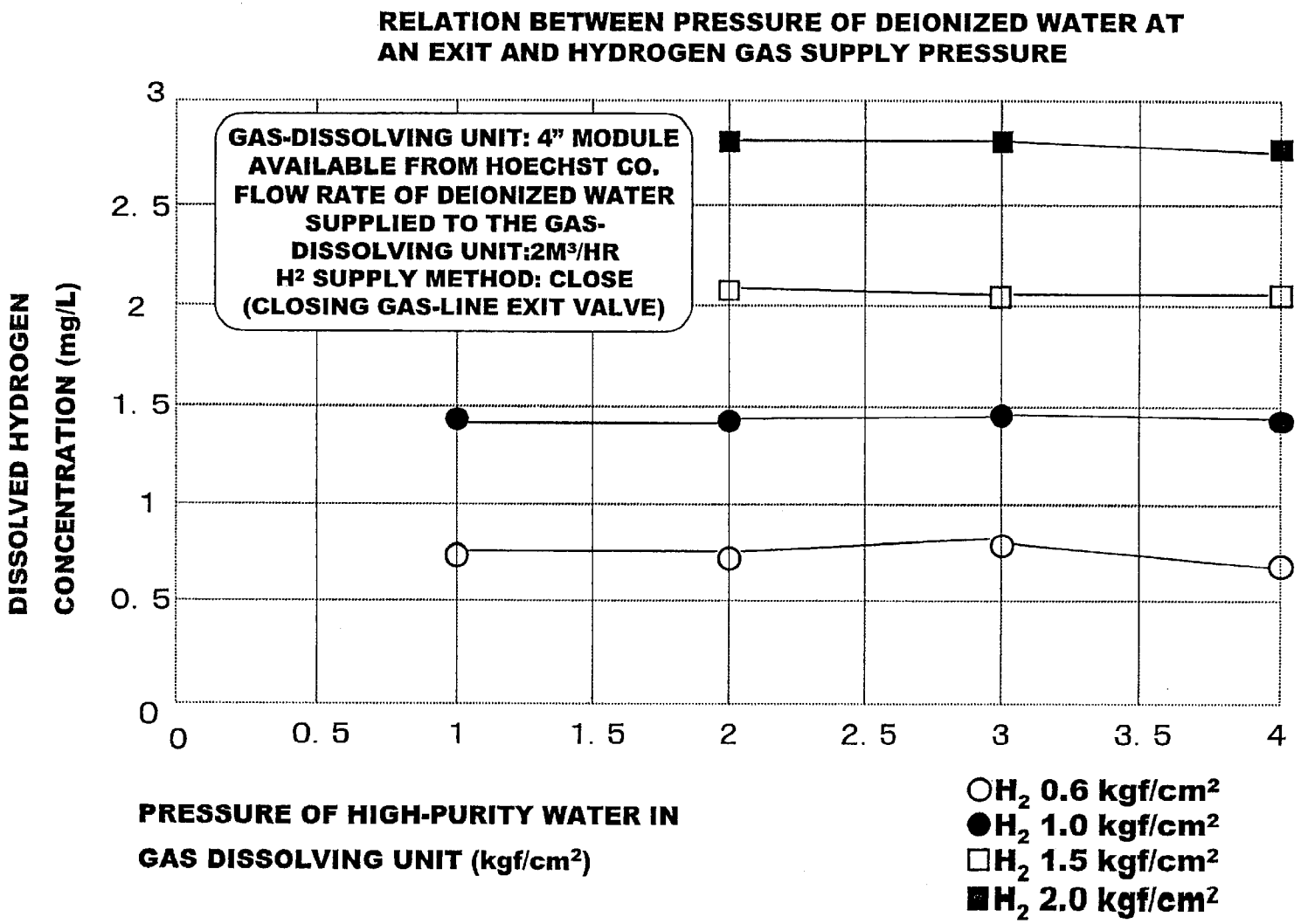
FIG. 6 is a graph showing the test results of Example 1.

The test results are shown in FIG. 6. As can be seen from FIG. 6, the pressure of high-purity water in the gas-dissolving unit did not affect the amount of dissolved gas. This means that the difference of the pressure between inside and outside of the hollow fiber membrane module dose not affect the amount of dissolved gas. Namely, it was found that the hydrogen gas supply pressure governs the amount of dissolved gas.

Therefore, the amount of dissolved gas can be controlled well through the hydrogen gas supply pressure.

EXAMPLE 2

In this example, the time required to reach a predetermined amount of dissolved gas was investigated for each constant gas supply pressure using the cleaning solution preparation device shown in FIG. 1.

The test conditions were as follows:

Flow rate of high-purity water supplied to the gas-dissolving unit:

2 $m^3$/hr

Pressure of high-purity water in the gas-dissolving unit:

2 kgf/$cm^2$

Hydrogen gas supply pressure:

D: 0.5 kgf/$cm^2$ (1.0 kgf/$cm^2$)

C: 1 kgf/$cm^2$ (1.0 kgf/$cm^2$)

B: 1.5 kgf/$cm^2$ (1.5 kgf/$cm^2$)

A: 2 kgf/$cm^2$ (2 kgf/$cm^2$)

The values in the parentheses denote the pressure of deionized water supplied to the water electrolyzer.

Gas-dissolving unit: 4" module available from Hoechst Co.

Figure 7:
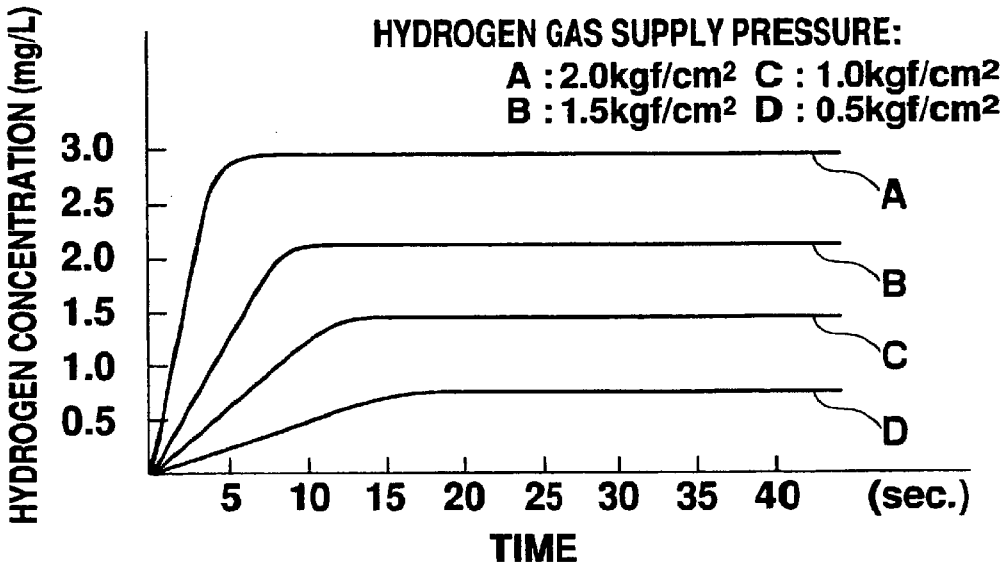
FIG. 7 is a graph showing the test results of Example 2.

The test results are shown in FIG. 7. As can be seen from FIG. 7, not only could more gas be dissolved in the case of the hydrogen gas supply pressure of 1.5 kgf /$cm^2$ than in the case of 1.0 kgf/$cm^2$, but the time required to reach the predetermined amount of dissolved gas could also be shortened with a hydrogen gas supply pressure of 1.5 hgf/$cm^2$.

Figure 11:
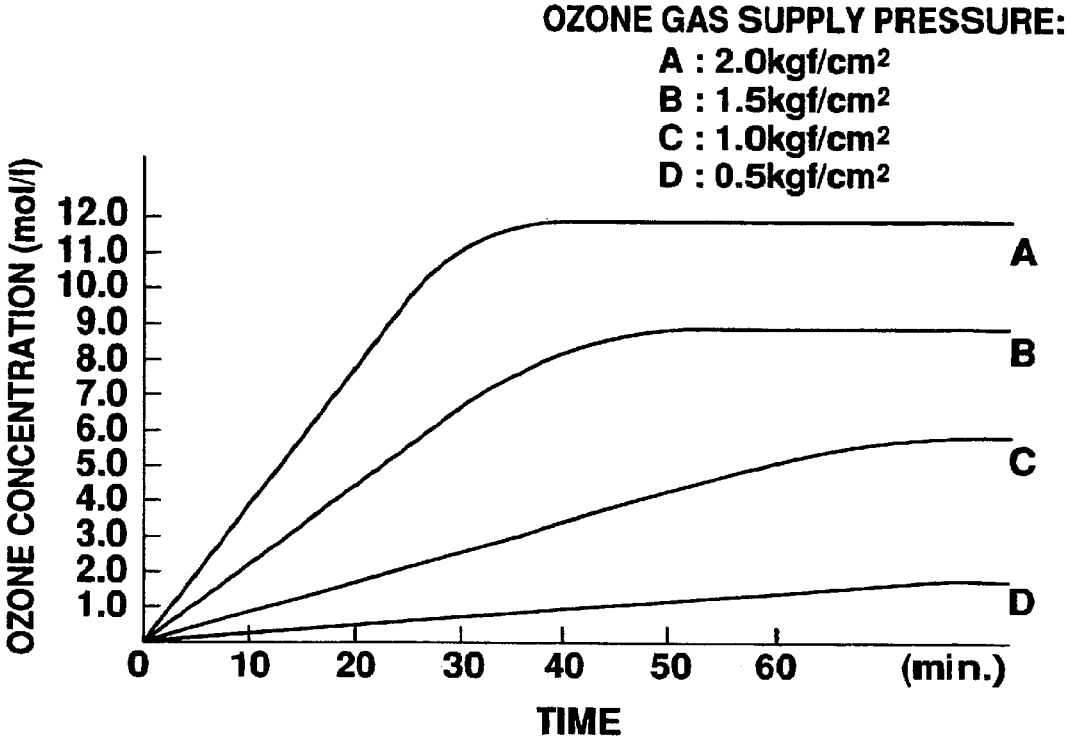
FIG. 11 is a graph showing the relation of dissolving time vs. ozone concentration in deionized water for each supply pressure of an ozone gas.

The investigations similar to the above were conducted with regard to an ozone gas and an inert gas dissolved in deionized water. FIG. 11 shows the results of the ozone gas (in which the same device as shown in FIG. 1 was used.) and inert gas (in which the same device as shown in FIG. 5 was used). The results of the ozone gas and inert gas had the same pattern as the above results for hydrogen gas.

EXAMPLE 3

In this example, a cleaning solution was prepared by using the cleaning solution preparation device shown in FIG. 1, and the test was conducted to investigate the effect of the hydrogen supply pressure on the cleaning effectiveness.

The test conditions were as follows: Substrate used for the test: $Al_2O_3$ particle/Cr/glass Wash water: hydrogen gas-dissolved high-purity water Method for Cleaning spin cleaning revolution 300 rpm ultrasonic wave frequency 1.5 MHz output 48 W Pressure of Hydrogen Gas (the Concentration of Hydrogen Gas in High-purity Water)

0 kgf/$cm^2$ (0 ppm)

1 kgf/$cm^2$ (1.1 ppm)

1.5 kgf/$cm^2$ (2.0 ppm)

2 kgf/$cm^2$ (2.8 ppm)

3 kgf/$cm^2$ (4.0 ppm)

4 kgf/$cm^2$ (5.5 ppm)

5 kgf/$cm^2$ (7.0 ppm)

Cleaning time: 15 sec.

Figure 8:
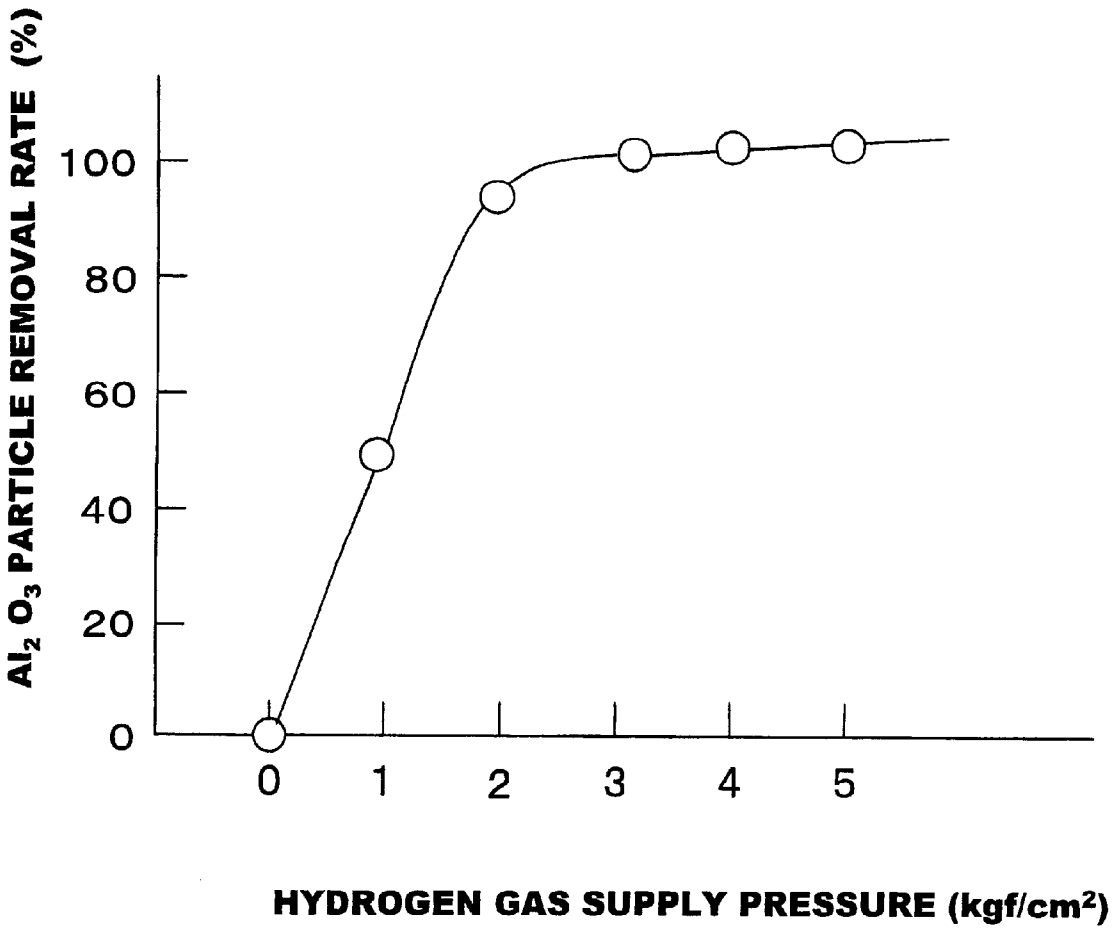
FIG. 8 is a graph showing the test results of Example 3.

The test results are shown in FIG. 8. As can be seen from FIG. 8, when the gas supply pressure became 1.5 kgf/$cm^2$ (hydrogen concentration 2.0 ppm) or more, the removal rate of Al2O3 particles approached 100%, showing excellent cleaning effectiveness.

Figure 9:
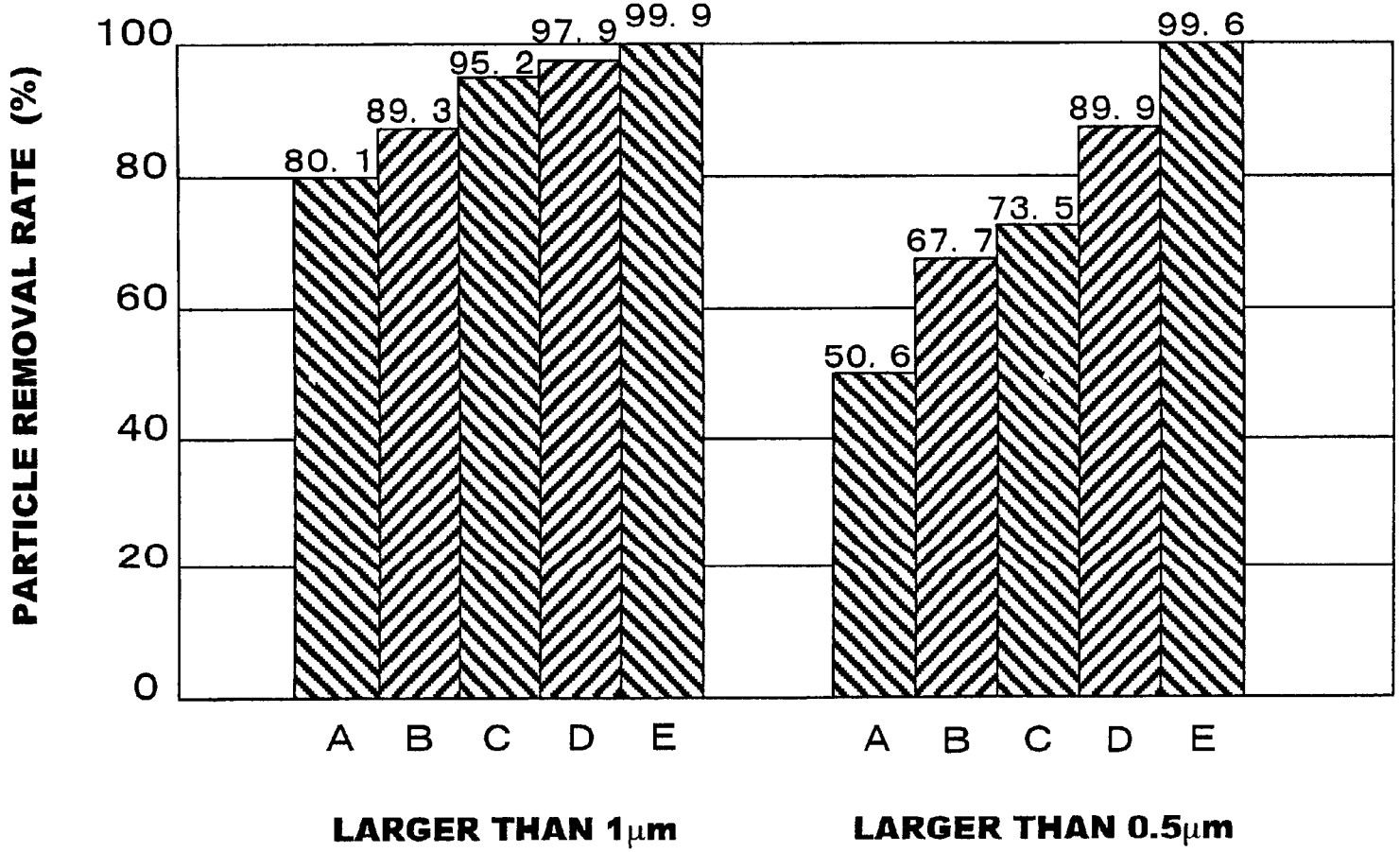
FIG. 9 is a graph showing some of the test results of Example 3, together with Comparative Example.

FIG. 9 shows the removal rate in the case of hydrogen gas pressure of 1.5 kgf/$cm^2$ during the above test, together with the result of comparative example.

FIG. 9 also shows that when the gas supply pressure became atmospheric pressure or more, it is possible to prepare cleaning solutions exhibiting excellent cleaning effectiveness.

Cleaning solutions used in tests presented in FIG. 9 were as follows:

A: nitrogen gas dissolved high-purity water comparative example

B: hydrogen gas dissolved high-purity water comparative example at the atmospheric pressure (hydrogen gas concentration 1.3 ppm)

C: $NH_4OH$ aqueous solution comparative example

D: hydrogen gas dissolved high-purity comparative example water at 1.5 kgf /$cm^2$ (hydrogen gas concentration 2.0 ppm)

E: cathode water (pH=10.2) comparative example

EXAMPLE 4

In this example, the effect of degassing of high-purity water prior to dissolving gas therein was investigated. Cleaning solutions tested were as follows:

F: hydrogen gas dissolved in high-purity water at 1.5 kgf/$cm^2$ (hydrogen gas concentration 1.3 ppm, nitrogen gas 14 ppm), without prior degassing G: hydrogen gas dissolved in high-purity water at atmospheric pressure (hydrogen gas concentration 1.3 ppm, nitrogen gas: nil), with prior degassing H: hydrogen gas dissolved in high-purity water at 1.5 kgf/$cm^2$ (hydrogen gas concentration 1.9 ppm, nitrogen gas 14 ppm), without degassing I: hydrogen gas dissolved in high-purity water at the atmospheric pressure (hydrogen gas concentration 2.0 ppm, nitrogen gas: nil), with prior degassing The other test conditions were the same as those in the Example 3.

Figure 10:
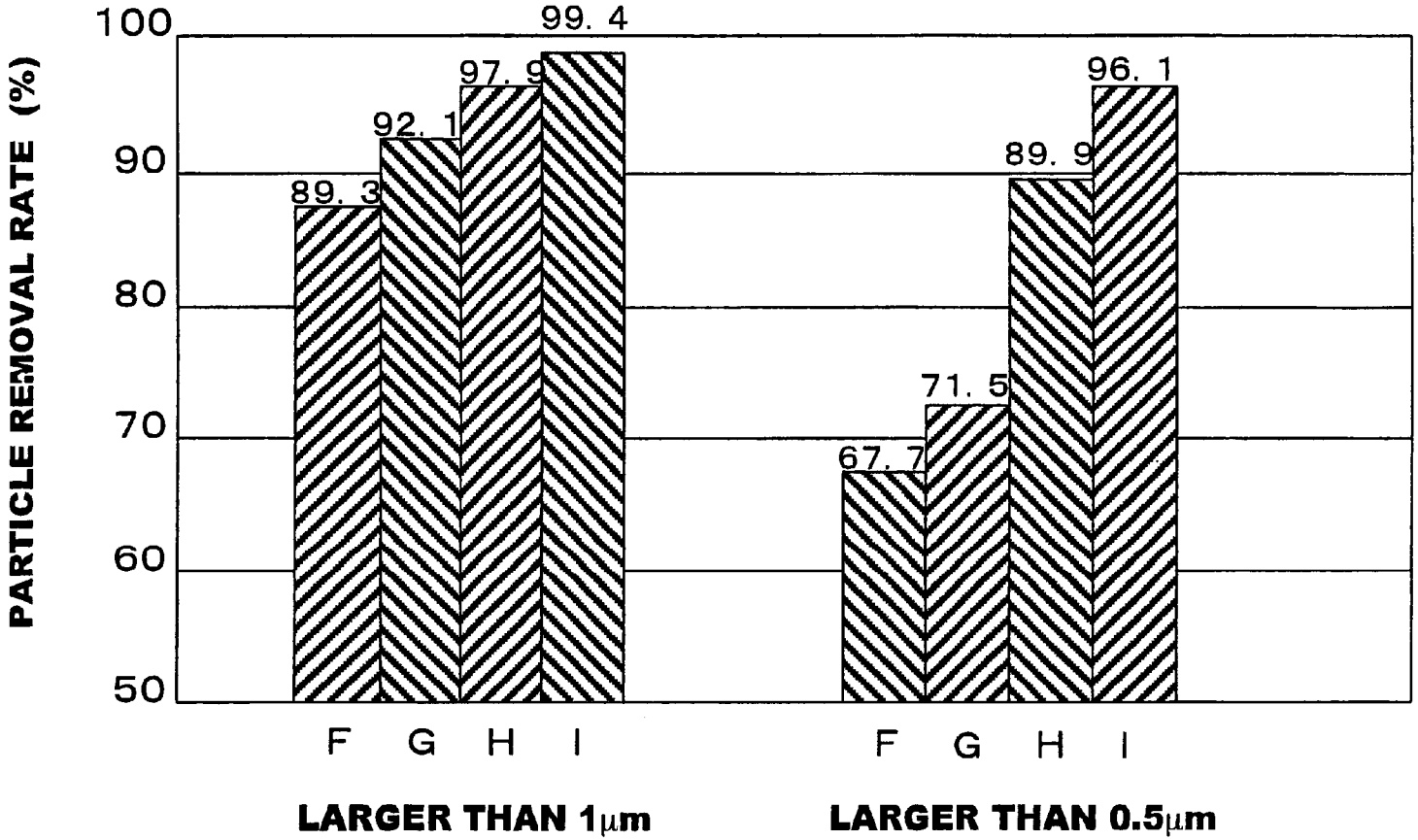
FIG. 10 is a graph showing the test results of Example 4.

The test results are shown in FIG. 10. As can be seen from FIG. 10, dissolving gassing in high-purity water with prior degassing significantly improved the cleaning effectiveness as compared with dissolving gases in high-purity water without prior degassing. Particularly significant is the improvement of cleaning effectiveness for particles in the 0.1 $\mu$m–0.5 $\mu$m range. For all the examples mentioned above were employed ultrasonic waves during cleaning. However, needless to say, brush cleaning or high-pressure spray cleaning may be used with or without ultrasonic wave.

EXAMPLE 5

In this example, cleaning effectiveness was investigated when ultrasonic-wave cleaning was conducted by using the following various cleaning solutions: dissolved in deionized water were mixed gas of hydrogen gas and helium or argon gas as inert gas; nitrogen gas alone; argon gas alone. The other test conditions during cleaning were the same as those in Example 3.

Cleaning solutions tested were more specifically as follows:

J: gas-dissolved high-purity water: partial pressure of hydrogen gas; 1.0 kgf/cm$^2$, partial pressure of argon gas; 0 kgf/cm$^2$ K: gas-dissolved high-purity water: partial pressure of hydrogen gas; 0.9 kgf/cm$^2$, partial pressure of helium gas; 0.1 kgf/cm$^2$ L: gas-dissolved high-purity water: partial pressure of hydrogen gas; 0.9 kgf/cm$^2$ partial pressure of argon gas; 0.1 kgf/cm$^2$ M: gas-dissolved high-purity water: partial pressure of hydrogen gas; 1.5 kgf /cm$^2$, partial pressure of argon gas; 0 kgf/cm$^2$ N: gas-dissolved high-purity water: partial pressure of hydrogen gas; 1.4 kgf/cm$^2$, partial pressure of argon gas; 0.1 kgf/cm$^2$ O: gas-dissolved high-purity water: partial pressure of nitrogen gas; 1.0 kgf/cm$^2$ P: gas-dissolved high-purity water: partial pressure of argon gas; 1.0 kgf/cm$^2$ In all cases, degassing was conducted prior to dissolving gas in high-purity water to reduce dissolved oxygen gas and nitrogen gas to 1 ppm or less, respectively.

Figure 12:
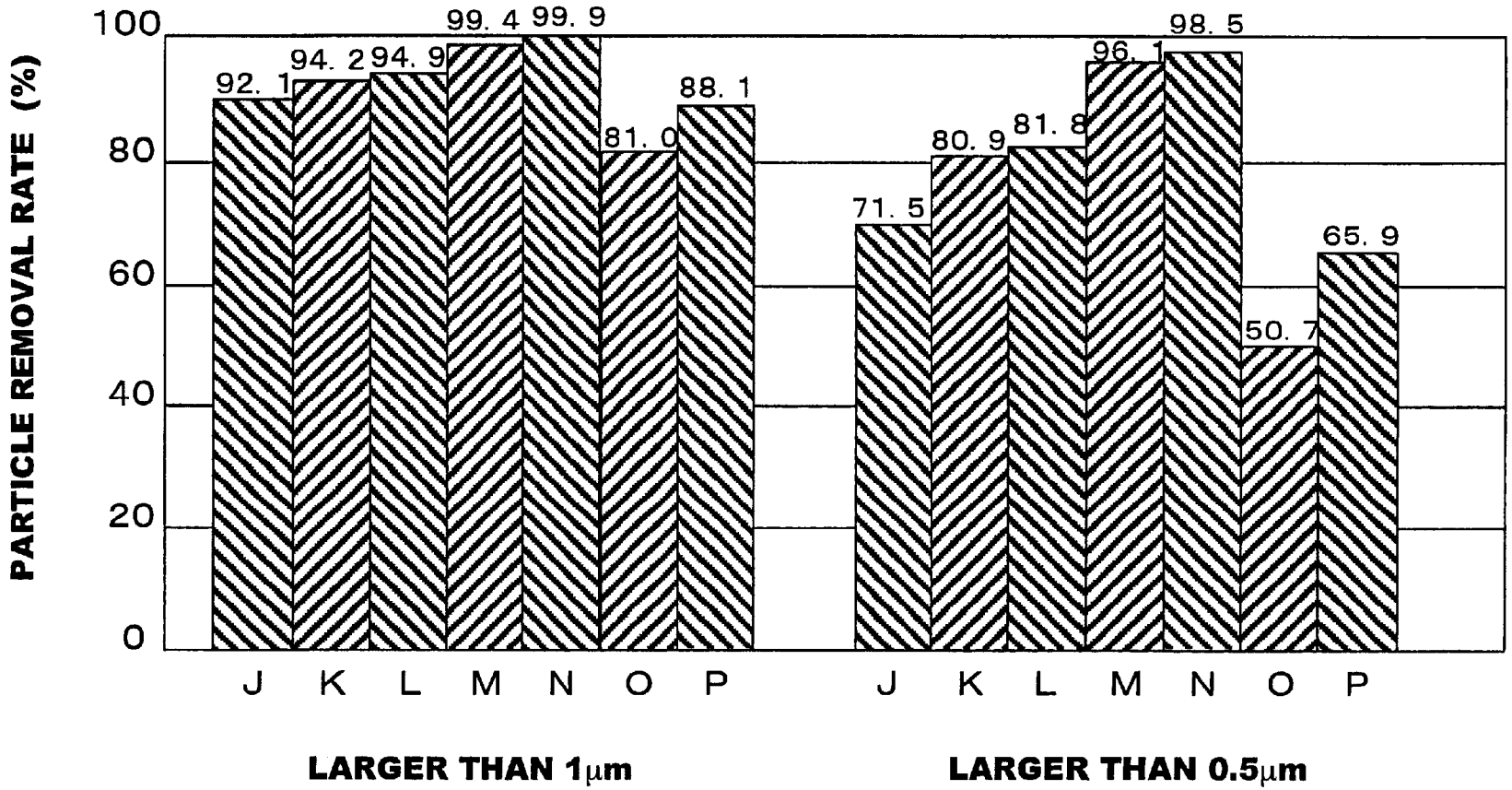
FIG. 12 is a graph showing the test results of Example 5.

The test results are shown in FIG. 12. As can be seen from FIG. 12, dissolving a mixture of hydrogen and inert gases (in this case, helium or argon gas) significantly improved the cleaning effectiveness as compared with dissolving hydrogen gas alone. Namely, cleaning effectiveness was improved for particles sized 5 $\mu$m or less, as well as those of 1.0 $\mu$m or less. Furthermore, it was found that cleaning solution with dissolved argon gas alone had a better particle removing effect than that of a cleaning solution with dissolved nitrogen alone.

As described above, there is provided according to the present invention a method and device that can prepare highly-concentrated, gas dissolved cleaning solutions in a short period of time.

What is claimed is:

1. A method for preparing cleaning solutions for cleaning objects, said method comprising the step of dissolving in deionized water hydrogen gas, or a mixture of hydrogen gas and an inert gas, by controlling a supply pressure of said gas at a value exceeding atmospheric pressure, wherein controlling the supply pressure at a value exceeding atmospheric pressure increases the amount of gas dissolved and reduces the amount of time necessary to dissolve the gas relative to controlling the supply pressure at a pressure exceeding atmospheric pressure.

2. The method for preparing cleaning solutions according to claim 1, wherein, while dissolving said gas in deionized water, the supply pressure of said gas is controlled at absolute pressures in a range from a pressure exceeding atmospheric pressure to 5 kgf/cm$^2$.

3. The method for preparing cleaning solutions according to claim 1, wherein said deionized water is degassed and then said gas is dissolved in the degassed deionized water.

4. The method for preparing cleaning solutions according to claim 1, wherein said gas is dissolved by diffusing said gas in deionized water through a gas permeable membrane.

5. The method for preparing cleaning solutions according to claim 1, wherein said gas is supplied from a high-pressure cylinder and the supply pressure of said gas is controlled by a pressure reducing valve.

6. A method for preparing cleaning solutions according to claim 1, wherein a water electrolyzer is used as gas supply source for said gas and the supply pressure or said gas is controlled by controlling the pressure of water supplied to said electrolyzer.

7. The method of claim 1, wherein the gas is dissolved in a container that maintains the gas in a pressurized state.

8. The method of claim 1 wherein the object comprises an electronic part.

* * * * *

UNITED STATES PATENT AND TRADEMARK OFFICE

CERTIFICATE OF CORRECTION

PATENT NO. : 6,509,305 B1
DATED : January 21, 2003
INVENTOR(S) : Eui-Yeol Oh et al.

It is certified that error appears in the above-identified patent and that said Letters Patent is hereby corrected as shown below:

Column 12,
Line 43, replace "or" with -- of --

Signed and Sealed this

Second Day of August, 2005

JON W. DUDAS
*Director of the United States Patent and Trademark Office*